US005279456A

United States Patent [19]

Bernstein

[11] Patent Number: 5,279,456

[45] Date of Patent: Jan. 18, 1994

[54] DIAMOND FOLD FOOD CARRYOUT ENVELOPE

[75] Inventor: Linda A. Bernstein, Campbell Hall, N.Y.

[73] Assignee: International Paper Company, Purchase, N.Y.

[21] Appl. No.: 10,936

[22] Filed: Jan. 29, 1993

[51] Int. Cl.[5] ..... B65D 27/00

[52] U.S. Cl. ..... 229/87.08; 229/75; 229/80.5; 229/87.03

[58] Field of Search ..... 229/75, 80.5, 87.03, 229/87.08, 92, DIG. 13

[56] References Cited

U.S. PATENT DOCUMENTS

| | | | |
|---|---|---|---|
| 284,297 | 9/1883 | Hartwell . | |
| 561,762 | 6/1896 | Clarke . | |
| 923,182 | 6/1909 | Joachim . | |
| 1,035,109 | 8/1912 | Wasmus . | |
| 1,288,548 | 12/1918 | Finkenhagen . | |
| 1,385,831 | 7/1921 | Hulbert . | |
| 1,815,654 | 7/1931 | Lazar . | |
| 2,066,849 | 1/1937 | Morse . | |
| 2,085,038 | 6/1937 | Perreton | 229/87.08 X |
| 2,307,998 | 1/1943 | Eaton . | |
| 2,432,075 | 12/1947 | Jennings | 229/87.08 X |
| 2,437,934 | 3/1948 | Brink . | |
| 2,831,624 | 4/1958 | Lever . | |
| 3,414,185 | 12/1968 | Young | 229/75 |
| 4,484,350 | 11/1984 | Gordon . | |
| 4,618,992 | 10/1986 | La Grotteria . | |
| 4,723,700 | 2/1988 | Wischusen | 229/87.08 X |
| 4,744,509 | 5/1988 | Buchler-Dopheide . | |
| 4,754,914 | 7/1988 | Wischusen . | |
| 4,917,291 | 4/1990 | Saiki et al. | 229/922 X |

FOREIGN PATENT DOCUMENTS

| | | | |
|---|---|---|---|
| 3920074 | 1/1991 | Fed. Rep. of Germany | 229/80.5 |

*Primary Examiner*—Allan N. Shoap
*Assistant Examiner*—Jes F. Pascua
*Attorney, Agent, or Firm*—Michael J. Doyle

[57] ABSTRACT

A fast food wrapper for hamburgers or the like is fashioned from a single square or diamond shaped sheet of paper, the food contacting surface of the blank coated with a food grade grease resistant composition. The blank is provided with a fold lines both parallel and orthogonal to an imaginary axis joining the top and bottom tips of the blank. These tips are provided with portions of latching elements. The side or lateral blank tips are folded towards the middle to form an expansion bellows along both of the sides and are adhesively tacked together. The bottom of the blank is folded upwardly and also adhesively tacked. In use, the hamburger is placed within the wrapper and the top of the wrapper folded over the hamburger and latched. The wrapper may be unfolded so as to function as a napkin or paper plate during eating.

4 Claims, 3 Drawing Sheets

FIG. 3
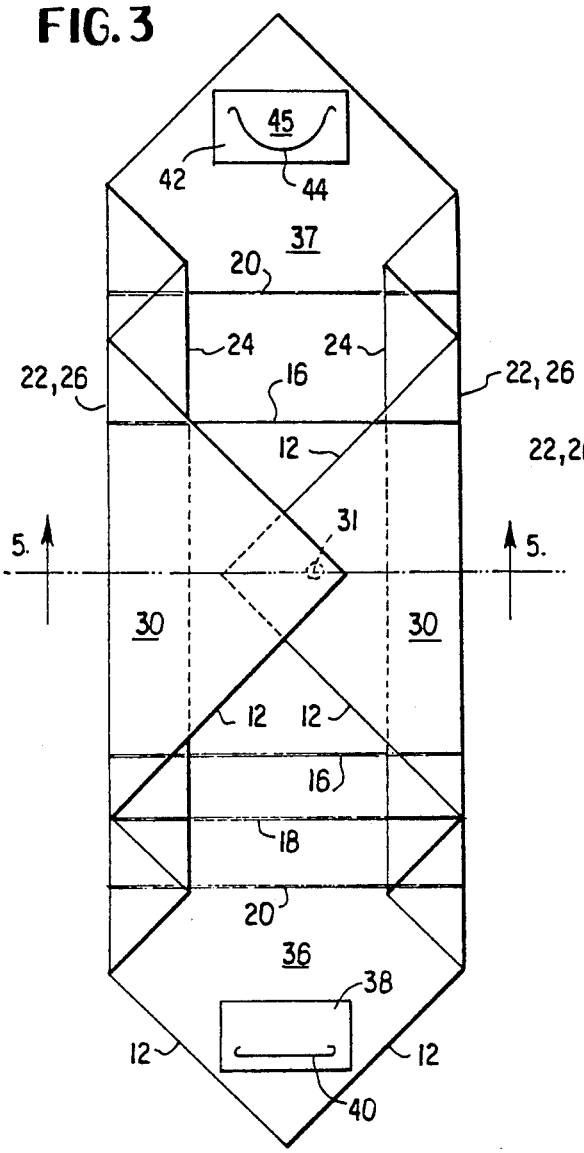
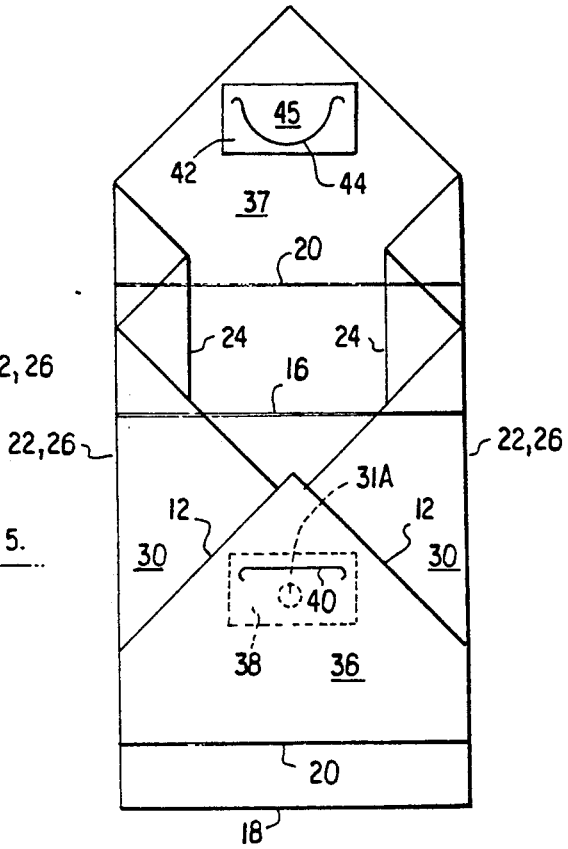
FIG. 4
FIG. 5
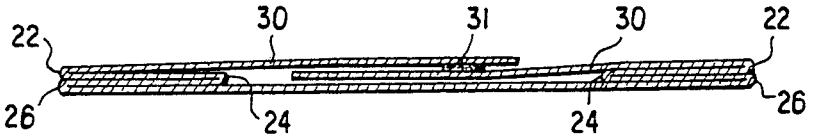

DIAMOND FOLD FOOD CARRYOUT ENVELOPE

BACKGROUND OF THE INVENTION

This invention relates to a wrapper or envelope particularly adapted for the packaging of fast foods such as hamburgers. The art is aware of such envelopes or wrappers in general, such as shown in U.S. Pat. No. 4,754,914 issued to Wischusen. The art is also aware of latch constructions for holding an envelope or wrapper closed, such as shown in U.S. Pat. No. 2,437,934 issued to Brink. However, there still exists a need for a unitary wrapper for a hamburger or the like fashioned from a single sheet of paper provided on one surface with a grease resistant coating and which can be inexpensively made and is easy to use.

SUMMARY OF THE INVENTION

According to the practice of this invention, a wrapper or envelope for fast food products, such as hamburgers, is formed from a square, single sheet of paper coated on its food contacting surface with a grease resistant composition, such as an FDA approved coating. The paper sheet or blank may be considered diamond shaped and is provided with a plurality of horizontally and vertically extending fold lines. The upper and lower ends of the blank are provided with respective tongue and slot latch elements which may be reinforced. Some of the vertically extending fold lines produce side expansion bellows in the wrapper completed, folded. The bottom tip of the blank in the completed wrapper is folded over and adhesively tacked in place. In use, a hamburger is inserted into the wrapper and the wrapper upper tip is folded over the top of the hamburger and latched to the lower tip. To obtain access to the hamburger, the user unlatches the wrapper to open it. The adhesive tacks employed are of such a nature (of known compositions) that they may be manually ruptured without tearing the wrapper so that the latter can be unfolded and thus function as a napkin upon which to place the hamburger while it is being consumed.

BRIEF DESCRIPTION OF THE DRAWINGS

FIG. 3 is a view similar to FIG. 1 and illustrates a first folding step in the formation of the wrapper.

FIG. 4 is a view similar to FIG. 3 and illustrates a later folding step in the formation of the wrapper.

FIG. 5 is a view taken along section 5—5 of FIG. 4.

DETAILED DESCRIPTION OF THE INVENTION

Figure 1:
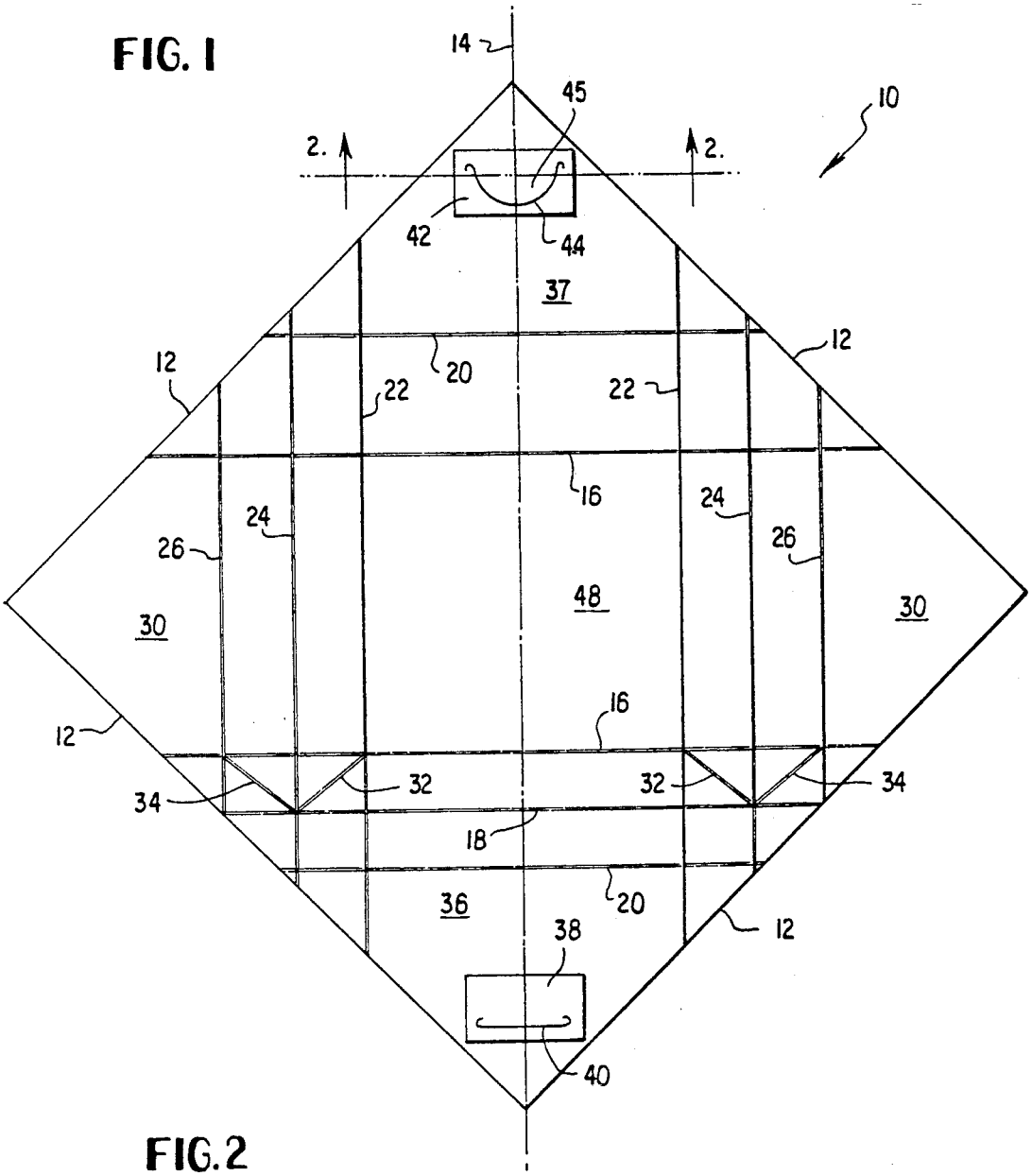
FIG. 1 is a plan view of a unitary blank of paper, coated on one surface with a grease resistant composition and from which the wrapper of this invention is formed.
Figure 2:
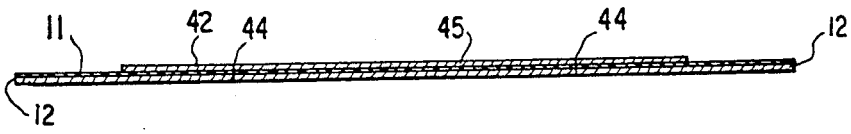
FIG. 2 is a view taken along section 2—2 of FIG. 1.

Referring now to FIGS. 1 and 2 of the drawings, a generally square blank of paper 10 is coated on that surface which faces the reader with a grease resistant composition 11, such as any of known FDA approved grease resistant compositions. Each of the four edges of the blank is denoted as 12, and for convenience of description, the blank 10 will be referred to as diamond shaped and has an imaginary vertical axis 14 from its lower to its upper tip. Two horizontally extending fold lines 16 are typically, but not necessarily, equidistantly spaced from the midpoint of the blank as measured vertically along axis 14. Similarly, each of a pair of vertically extending fold lines 22 is equidistantly spaced from axis 14. Fold lines 16 and 22 extend to respective edges 12 of the blank. Horizontally extending fold line 18 is provided at the lower half of the blank, and the blank also includes horizontally extending fold lines 20 equidistantly spaced from the midpoint of axis 14, as measured vertically. Pairs of vertically extending fold lines 24 and 26 also extend to the edges 12 of the blank and are located equidistantly on both sides of axis 14. The right and left tips of the blank are each designated as 30. Fold lines 32 at 45 degrees to the vertical, extend from the intersections of lines 16, 22, and 18, 24, respectively, as do 45 degree fold lines 34 from the intersection of fold lines 16, 26 and 22, 18. It is seen that fold lines 34 are parallel to adjacent edges 12, while fold lines 32 are also parallel to other edges 12. The bottom tip is denoted as 36, while the top tip is denoted as 37. Upper tip 37 is preferably provided with a rectangular paper reinforcement 42, with both the reinforcement and the blank having an arcuate slit 44 therein, the slit having curved ends, to define a latch portion tongue 45. Similarly, the lower tip 36 is preferably provided with a rectangular paper reinforcement 38, with the latter and blank 10 provided with a latch portion defined by cut line 40 extending through these members. Other latch configurations may be employed. Score lines 22 and 16 define a central panel or section 48.

Referring now to FIG. 3 of the drawings, the first folding step for the formation of the wrapper is shown. The right and left tips 30 of blank 10 are folded about lines 22. Vertically extending fold lines 24 and 26 are folded so as to define an expansible bellows in the sides of the completed wrapper, with fold lines 22 and 26 overlapping each other also as shown at FIG. 5. The outermost portions of tips 30 are overlapped and one or more adhesive tacks 31 is employed to maintain the tips in this relative position. The nature of tack 31 is such that the user may pull the tips 30 apart so as to unfold the wrapper to the original configuration shown at FIG. 1.

Figure 7:
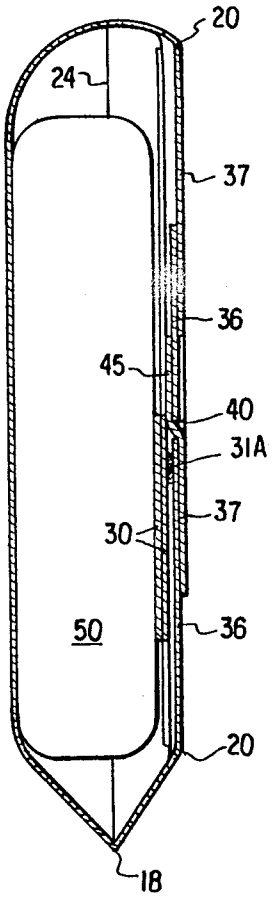
FIG. 7 is a view taken along section 7—7 of FIG. 6 illustrating the wrapper as enclosing a food product such as a hamburger, the upper and lower wrapper tips being latched.
Figure 6:
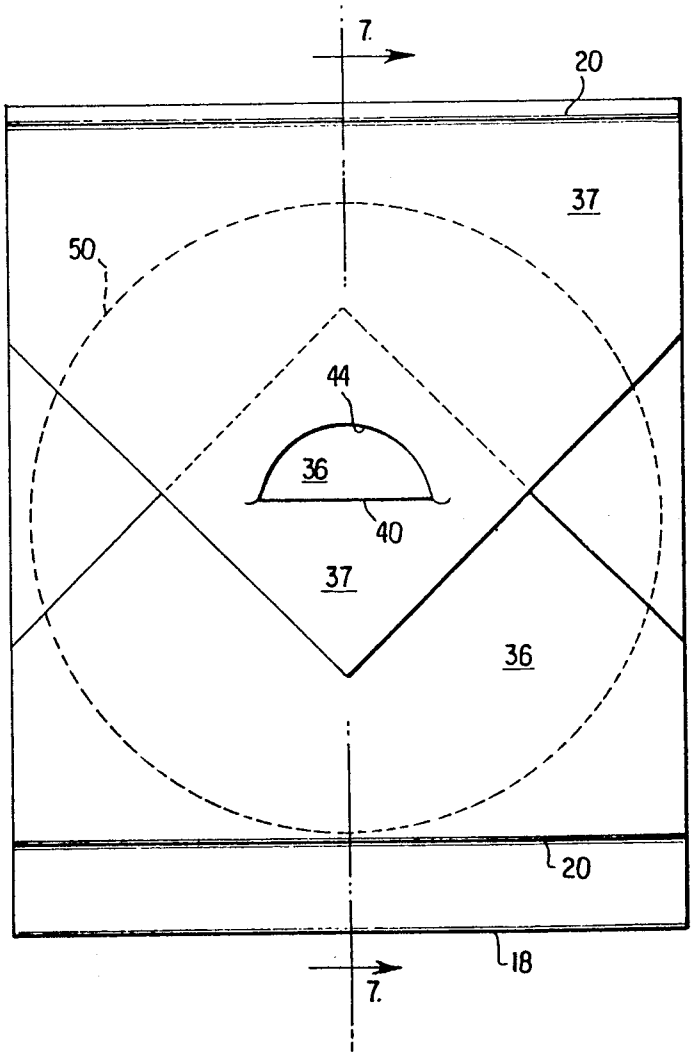
FIG. 6 is a view of the wrapper latched and having a hamburger therein.

Referring now to FIG. 4 of the drawings, lower tip 36 is folded about fold line 18 and a second adhesive tack 31A, located beneath cut line 40, is provided to hold lower tip 36 against the overlapped tips of right and left ends 30. The wrapper may be stored in the configuration of FIG. 4. In use, a hamburger 50 (see FIGS. 6 and 7) is inserted into the top of the wrapper, thus expanding the bellows defined by fold lines 22, 24, 26. Top wrapper tip 37 is now folded down about upper fold line 20. Tongue 45 is inserted through slit 40 so that the former projects behind the uppermost portion of tip 36, as seen at FIG. 7. The filled and latched wrapper is shown in plan view at FIG. 6. FIG. 7 shows the relationship between several of the wrapper portions in the latched configuration. To simplify the showing of FIG. 7, paper reinforcements 38 and 42 are not illustrated.

For consumption of the packaged hamburger sandwich 50, the consumer opens the latch by pulling down on tip 37 and withdrawing tongue 45 from slit 40. This permits reopening of the wrapper top to the general configuration of FIG. 4 and the user withdraws the hamburger. If desired, the wrapper may be spread open by pulling off or rupturing adhesive tacks 31A and 31 so as to restore the wrapper to the configuration shown at FIG. 1, the wrapper thus serving as a napkin or plate upon which to place the hamburger as it is being consumed.

Geometrical terms such as upper, lower, and the like are employed for the purposes of reference and description and are not intended to be limiting.

I claim:

1. A paper blank having a food grade grease resistant coating on one surface thereof, the blank being diamond shaped and having four tips and having an imaginary vertical axis passing from the upper most blank top to the lowermost blank top, the blank having left and right tops each laterally spaced from said vertical axis, a plurality of both vertically and horizontally extending, fold lines extending between respective blank edges, a plurality of said fold lines located on both sides of said vertical axis and both above and below said right and left tops, said uppermost and lowermost blank tops each having means for releasably latching them together, pairs of 45 degree fold lines extending between intersections of some of said horizontal and vertical fold lines, said 45 degree fold lines located in the lower half of said blank.

2. A paper wrapper for a food product, said wrapper formed form a unitary, generally diamond shaped paper blank coated on one surface thereof with a food grade grease resistant coating, the blank having right and left tips which are overlapped and secured together, the blank having upper and lower tops each having means to releasably latch said upper and lower tips together, said lower tip secured to one of said overlapped right and left tips, said wrapper having inwardly extending expansible bellows along its sides, said bellows being folded so that their respective edges are parallel to a vertical axis, said vertical axis defined by a straight line from the upper tip to the lower tip, whereby a hamburger sandwich placed in the wrapper contacts said grease resistant coating said causes expansion and unfolding of said side bellows, said upper and lower wrapper tips being releasably latched together by said latch means to close the wrapper.

3. The wrapper of claim 2 wherein said right and left tips are adhesively releasably secured together so that they may be separated without tearing the paper.

4. The wrapper of claim 2 wherein said lower tip is adhesively releasably secured to one of said right and left tips so that the lower tip may be pulled off without tearing the paper.

* * * * *